United States Patent [19]

Kolve

[11] Patent Number: 4,576,078

[45] Date of Patent: Mar. 18, 1986

[54] REINFORCED SAW CHAIN TOOTH

[76] Inventor: Gerald C. Kolve, 5833 SW. Lane Ct., Portland, Oreg. 97221

[21] Appl. No.: 599,769

[22] Filed: Apr. 13, 1984

Related U.S. Application Data

[63] Continuation-in-part of Ser. No. 503,334, Jun. 10, 1983.

[51] Int. Cl.[4] ..... B27B 33/14

[52] U.S. Cl. ..... 83/833; 83/832; 83/834

[58] Field of Search ..... 83/830, 831, 832, 833, 83/834

[56] References Cited

U.S. PATENT DOCUMENTS

| | | | |
|---|---|---|---|
| 3,028,889 | 4/1962 | McCarty | 145/108 A |
| 3,543,817 | 12/1968 | Anderson | 83/833 |
| 3,745,870 | 7/1973 | Lemery | 83/833 |
| 4,426,900 | 1/1984 | Lemery | 83/833 |

FOREIGN PATENT DOCUMENTS

| | | | |
|---|---|---|---|
| 724784 | 2/1955 | United Kingdom | 83/830 |

*Primary Examiner*—Donald R. Schran
*Attorney, Agent, or Firm*—Seed and Berry

[57] ABSTRACT

A side cutter tooth 10 or other chain saw tooth includes a tip 36 which extends upwardly substantially parallel to the plane of the body 24 or which is inclined inwardly at an angle of 0°–50° towards the angle of the body 24 to create improved resistance to crimping and breakage of the cutter element 34 of the tooth 10 so that the tooth will not deflect outwardly when exposed to a downward force, such as often experienced during a bind or pitch. Protection of the tooth 10 is also provided by including at least one corrugation 42 in the vincinty of the curl outwardly from the body 24 to reinforce this curl and to further reduce crimping and breakage. That is, the corrugation 42 includes a stamped portion of the link 20 or 22 spanning the intersection of the cutter element 34 with the body 24.

11 Claims, 6 Drawing Figures

REINFORCED SAW CHAIN TOOTH

DESCRIPTION

Reference to Related Invention

This application is a continuation-in-part of U.S. Ser. No. 503,334, filed on June 10, 1983.

TECHNICAL FIELD

This invention relates to an improved saw chain having reinforced teeth. More particularly, this invention relates to a break-resistant side cutter tooth for center-link saw chains.

BACKGROUND ART

U.S. Pat. No. 3,745,870 (incorporated by reference) disclosed a new and improved saw chain construction, including novel side cutter and raker teeth. The side cutter teeth could be easily formed and inexpensively manufactured. Flexible cutter elements permitted the teeth to flex laterally under cutting loads, thereby accommodating shocks from binding of the saw chain by forces directed inwardly upon the cutter elements. The improved side cutter tooth of that invention included a cutter element which had a complex curvature. As shown in FIG. 4 of that patent, each element first curved outwardly in a radius indicated by arrow 29. Second, each cutter element curved upwardly in a second radius indicated by arrow 31. Third, each cutter element extended in a final substantially straight course from the second radius 31 upwardly at a constant angle to the tip 32. Due to this final, straight portion, the side cutter element usually bent at the second radius 31 when it experienced inwardly directed forces. These inwardly directed forces reduced the 7° vertical angle of the element by moving the tip inwardly toward the centerline of the kerf. The forces lowered the relative position of the second radius 31 with respect to the first radius 29 and with respect to the body of the tooth, forming a crimp in the cutter element. Within a short time, the tooth broke at the crimp.

Having about three times better performance and longer life than earlier developed teeth, the side cutter tooth of U.S. Pat. No. 4,426,900 (incorporated by reference) had a cutter element that included a continuously curved portion which was attached to the body of the side cutter tooth and which extended outwardly in a half-space adjacent the body. The continuous curve of the cutter element caused the cutter element to bend substantially at the intersection of the body and the cutter element when the cutter element was exposed to inwardly directed forces (which tended to flatten the curved portion from the half-space into the plane of the body). In this way, crimping of the cutter element was substantially reduced. The intersection between the body and the cutter element provided greater resistance to deformation and, therefore, ensured that the tooth would perform better and longer than elements having a complex curvature, such as those in U.S. Pat. No. 3,745,870. The cutter element, however, still flexed laterally under cutting loads to reduce binding of the saw chain and to promote better performance. Thus, the improved side cutter tooth retained the advantages disclosed in U.S. Pat. No. 3,745,870 with increased cutting life. Breakage of these teeth, however, often was unacceptably high, especially when cutting soft woods, because the teeth could deflect outwardly when a load was directed downwardly on the element when attempting to pry the saw from a bind.

DISCLOSURE OF THE INVENTION

Further reduction of crimping and breakage of the cutter element of a side cutter tooth is provided by having the cutter tip of the element extend substantially parallel to the plane of the body over about its final 0.030"–0.035" or by having the tip tilt back inwardly toward the plane of the body in a straight line or a curve at an angle generally of between about 0°–50° with respect to the plane of the body.

Resistance to breaking is achieved by shaping the tip of the element so that a force directed downwardly on the element will not cause the element to deflect outwardly. That is, the resolved horizontal forces on the tip will be small enough that the tip will not deflect outwardly when trying to pry the saw from a bind. This feature is achievable by giving the inward and outward faces of the tip substantially similar slopes so that the resolved, horizontal forces acting on the tip will generally be small. Then, the tooth will dig into the wood and will not deflect outwardly and break. Outward deflection can be eliminated by shaping the tip of the element so that the angle or slope on the outside of the tooth is greater than the angle on the inside, as measured from the vertical. When shaped in this way, downwardly directed forces on the tip will cause the element to deflect inwardly, if at all, and will allow the chain to slip out of the pinch or bind. Prying will not create enormous horizontal forces due to the tip shape, and the tooth usually will not break. Other teeth almost always break due to the outward horizontal loads caused by prying.

Crimping and breakage may also be reduced with the addition of corrugations at the intersection of the lower bend or radius where it curls outwardly from the plane of the body. A corrugation or outwardly extending mound may be stamped into the element at the curl to provide the additional resistance against crimping.

While side cutter teeth usually have two mirror-image elements connected together so that the teeth simultaneously score both sides of the kerf, separate left-hand and right-hand side scorers might be used. In this circumstance, the tooth has only one cutter element or link incorporating the tip concept, the corrugation concept, or both concepts, as desired.

BEST MODE FOR CARRYING OUT THE INVENTION

Figure 1:
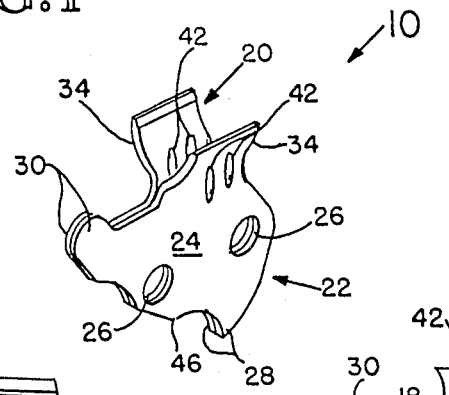
FIG. 1 is an isometric showing a preferred side cutter tooth of this invention.
Figure 2:
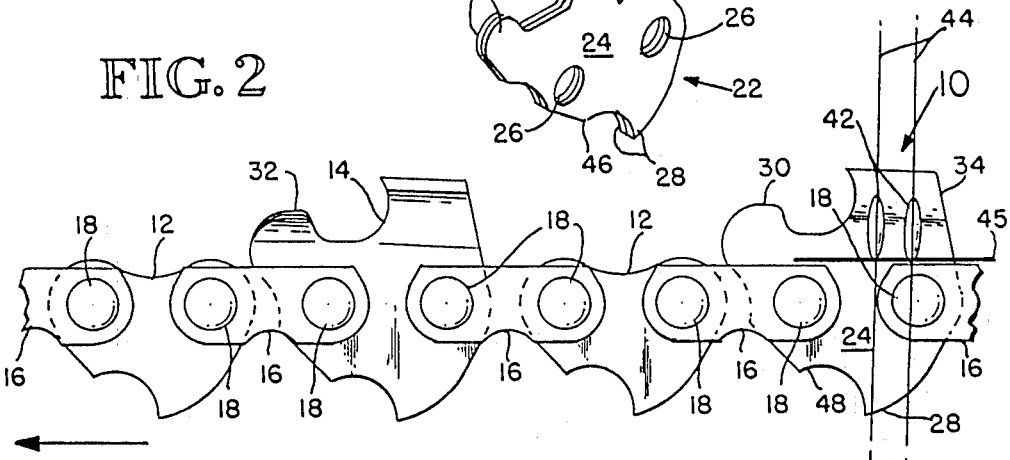
FIG. 2 is a side elevation of a portion of saw chain including a preferred side cutter tooth of this invention.

In a repeated series of center-mounted cutting teeth, as shown in FIG. 2, a side cutter tooth 10 is included with spacer links 12 and raker teeth 14 to form an endless belt of saw chain. Preferably, spacer links 12 engage the drive sprocket (not shown) to help drive the saw chain. They space the side cutter teeth 10 and raker teeth 14 sufficiently far apart so that the teeth perform optimally. Side links 16 and rivets 18 join the spacer links 12 and cutting teeth 10 and 14 in end-to-end pivotal relationship in the well-known manner, with the bottom surfaces of the side links 16 providing a surface for supporting the saw chain on the rails of the bar (not shown). The side links 16 are positioned on opposite sides of the center-mounted cutting teeth 10 and 14 and spacer links 112, and are preferably identical and interchangeable.

A preferred side cutter tooth 10 of the present invention includes two mirror-image links 20 and 22 which are placed side by side when riveted into endless belt of the saw chain. When positioned adjacent one another, the links 20 and 22 form a generally U-shaped cutting tooth 10 capable of simultaneously slitting both sides of the kerf when run as part of the saw chain. Each link has a body 24, including two rivet holes 26 alignable with the holes on the other link to allow pivotal attachment of the tooth 10 to the side links 16.

Each link 20 or 22 includes a root 28 which extends outwardly from the body 24 in the same plane as the body. The root 28 is capable of engaging the drive sprocket or a bar sprocket of the saw when the saw chain is moving around the bar. (Similarly, the spacer links 12 include roots.) A leading depth gauge 30 extends laterally outwardly from the body 24 in a direction substantially opposite the root 28 and in the plane of the body 24. As its name indicates, the depth gauge 30 regulates the depth of cut scored by the cutter elements 34 of the side cutter tooth 10. The raker teeth 14 also have analogous depth gauges 32, which commonly are offset from the centerline of the saw chain to provide more efficient performance when rakers 14 of the chain remove wood chips during cutting. Offset depth gauges 32 better insure that the raker teeth 14 remove wood chips of more constant thickness. In so doing, the raker teeth 14 improve the overall performance of the saw chain because they chip wood efficiently and do not clog with large chips.

Figure 4:
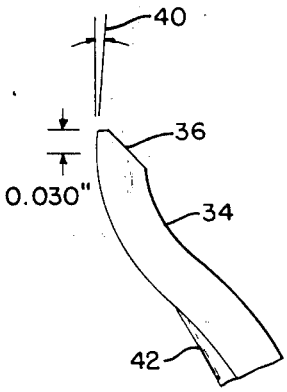
FIG. 4 is a detail of an alternative embodiment of a cutter element of a tooth similar to FIG. 1.

A trailing cutter element 34 extends laterally outwardly from the body 24 in a direction substantially opposite the root 28, yet is spaced somewhat behind the leading depth gauge 30. As shown in FIG. 4, the cutter tip portion 36 of the cutter element usually comprises only about the last 0.030"–0.035" of the cutter element 34. The cutter element 34 on one link 20 curls out of the plane defined by the body 24 into one of the half spaces defined by that plane. Analogously, the adjacent link 22 is a mirror image of the first link 20, and its cutter element 34 extends outwardly in an arc into the other half space defined by the plane of the body 24.

Figure 3:
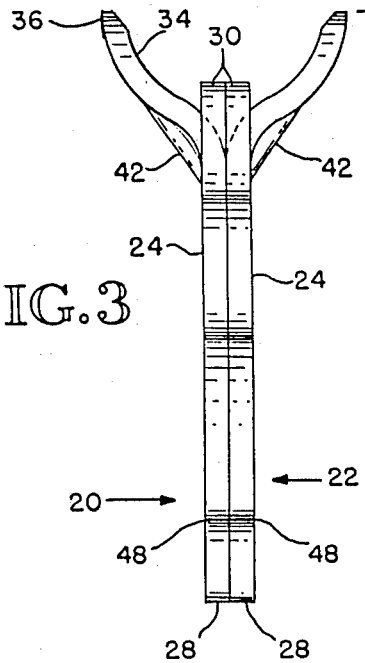
FIG. 3 is a front elevation of the preferred tooth, as shown in FIG. 1.

As illustrated in FIGS. 3 and 4, the cutter tip 36 of the present invention departs from the normal curve of the cutter element 34 and bends vertically or inwardly towards the plane defined by the body 24. That is, angle 40 is measured by a plane substantially parallel to the plane defined by the body 24 and a line drawn tangent to the cutter tip 36 from the point in the plane where the tip 36 deviates from the continuous curve of the cutter element. Thus, over about the final 0.030"–0.035", the cutter tip 36 extends inwardly towards the plane of the body 24 preferably at an angle from about substantially 0° to about 50°.

This inclination of the cutter tip 36 is important in reducing crimping and breakage of the cutter element 34. The inclination allows the teeth to slide in the kerf more readily when inwardly directed forces press against the cutter element 34. Without this inclination, the teeth crimp and break more easily because they stick in the sides of the cut, bend outwardly, and break when the saw is forceably removed from the cut. The cutter tip 36 of this design also allows the tooth to flex inwardly, as it is designed to do, when downward forces are exerted on the tip.

Each link 20 or 22 preferably includes at least one reinforcing corrugation 42 which is generally created by stamping the link 20 or 22 in the vicinity of the curling portion of the cutter element 34 from the body 24. That is, the corrugations 42 generally comprise an outwardly extending mound or ridge on the sides of the cutter tooth 10, but include an analogous depression within the U-shaped interior of the tooth 10. The thickness of metal for the tooth 10 is uniform throughout and the corrugation 42 is formed by stamping or drawing the metal in a die. Ordinarily, two corrugations 42, parallel to one another are placed in each link 20 or 22 in the vicinity of the intersection of the cutter element 34 with the body 24. These corrugations 42 provide additional reinforcement to the cutter element 34 at the intersection of the element 34 with the body, so that the tooth is better able to resist crimping or deforming.

Figure 5:
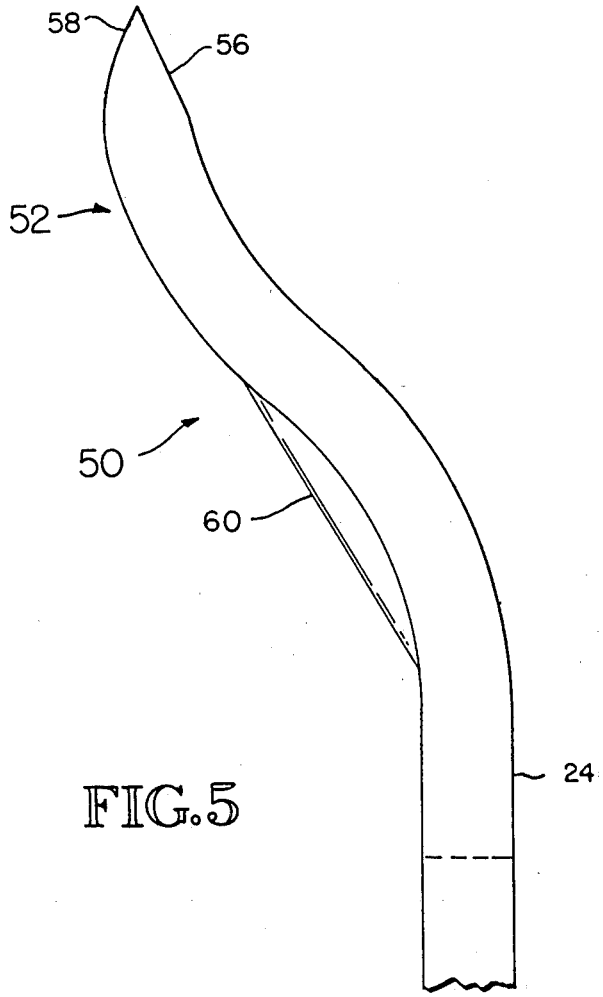
FIG. 5 is a detail of another cutter element of a tooth of the invention.

As shown in detail in FIG. 5, an element 50 can be improved further by shaping the tip 52 (about the final 0.035") so that the tooth is even more resistant to breaking. The element 50 ends at the tip 52 with an inwardly projecting portion that has analogously sloped inner and outer faces 56 and 58, sloped at between about 0°–50° when measured from the vertical. These faces may be designed so that, when a force is applied downwardly on the tip 52, the resolved horizontal component of the force acting on the tip 52 will be small enough that the tip 52 will not deflect substantially either inwardly or outwardly. The slope of the inner face 56, therefore, substantially equals the inverse of the slope of the outer face 58, in one embodiment. As shown, the inner face 56 forms about a 25° angle with the vertical. The outer face 58 may be straight or slightly curved (as shown in FIG. 5) so long as the resolved horizontal component of the downward force is small.

Alternatively, the tip 52 may be shaped so that the outer face 58 has a greater slope than the inner face 56 so that the element will deflect, if at all, inwardly when a downwardly directed force is exerted on the tip 52. Then, the element will slip on the kerf, and the saw can be removed from the pinch or bind. For example, the outer face 58 may slope at about 50° while the inner face 56 may slope at 25°.

Generally the tooth will also include corrugations 60 at the intersection of the element 50 to the body 24, as previously explained.

In a bind or pinch, old cutter elements would produce enormous horizontal components when prying the saw from the bind because the tip was ill-designed. With the improvement of the present invention, the teeth are resistant against breakage. In comparative tests, old style teeth (such as shown in FIG. 3) are quickly broken while an improved tooth rarely breaks. The new teeth may dig deeply into the wood during prying and cause the saw chain to stick, but the teeth will not break. Alternatively, the teeth will deflect inwardly due to the sloping of the tip and the chain will slip out of the cut.

Figure 6:
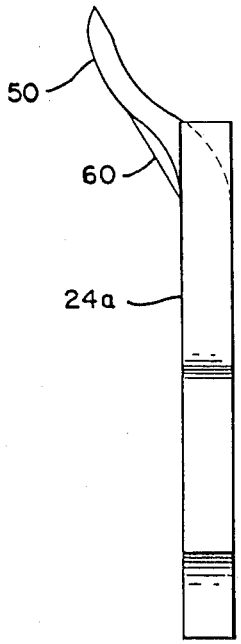
FIG. 6 is a front elevation of another side cutter tooth of this invention.

While described with respect to a conventional side cutter tooth having mirror-imaged elements 20 and 22 in side-by-side relationship, the tooth may be a left-hand or right-hand side scorer using only one of the elements and positioned on the chain with a body spacer (not shown). Alternatively, as shown in FIG. 6, the body 24*a* may be double width and have a right- or left-hand element 50 extending outwardly from it. The element includes the tip shaping concept, the reinforcing corrugations 60, or both, as desired.

If left- and right-hand scorers are used, usually the chain will include a series of teeth including a left-hand scorer, a right-hand scorer, a left raker, and a right raker, with appropriate spacer links. Other series can be used, but it is preferable to fully score the cut prior to raking out chips. A full-width raker may be used, so that the series would include side scorers, and one raker to cut the entire width of the kerf between the scores.

While preferred embodiments of this invention have been illustrated and described, the invention is capable of modification and addition without departing from its basic principles. Accordingly, the invention is not intended to be limited to the exact embodiments illustrated, which are presented only as examples. The scope of the invention should be determined by reference to the claims, which should be interpreted liberally and without limitation unless such interpretation is necessary in light of the pertinent prior art.

I claim:

1. A chain saw side cutter tooth comprising:

(a) a link having (i) a body defining a plane for the tooth and two half-spaces separated by the plane;

(ii) a root, extending from the body in the plane, capable of engaging a sprocket of the chain saw;

(iii) a leading depth gauge extending laterally outwardly from the body in a direction substantially opposite the root but in the plane;

(iv) a trailing cutter element extending laterally outwardly from the body in a direction substantially opposite the root, yet spaced behind the depth gauge, ending in a cutter tip, the element curling out of the plane into one half-space, the tip extending upwardly substantially vertically and substantially parallel to the plane of the body and the tip sloping back inwardly toward the plane of the body; and (b) a second link, being substantially a mirror image of the first link, positioned adjacent the first link in substantial alignment with the first link to form a side cutter tooth capable of simultaneously cutting slits on both sides of a kerf when moving as part of the saw chain.

2. The tooth of claim 1 wherein the tip slopes inwardly between 0°–50° with respect to the plane of the body.

3. The tooth of claim 2 wherein the tip is about the final 0.030″–0.035″ of the element.

4. The tooth of claim 2 wherein the element further includes at least one reinforcing corrugation in the vicinity of the curl out of the plane of the body to reinforce this curl and to further reduce crimping and breakage of the element.

5. The tooth of claim 2 wherein an outer face of the tooth slopes inwardly greater than the inner face of the tooth slopes outwardly.

6. The tooth of claim 1 wherein the element further includes at least one reinforcing corrugation in the vicinity of the curl out of the plane of the body to reinforce this curl and to further reduce crimping and breakage of the element.

7. The tooth of claim 6 wherein the element includes two spaced corrugations.

8. The tooth of claim 1 wherein the tip includes means for substantially eliminating outward deflection of each link when the tip experiences a downwardly directed force.

9. The tooth of claim 8 wherein the means for substantially eliminating deflection includes analogously sloped inner and outer faces for the tip.

10. A chain saw side cutter tooth comprising:

(a) a first link having (i) a body defining a plane for the tooth and two half-spaces separated by the plane;

(ii) a root, extending from the body in the plane, capable of engaging a sprocket of the chain saw;

(iii) a leading depth gauge extending laterally outwardly from the body in a direction substantially opposite the root but in the plane;

(iv) a trailing cutter element extending laterally outwardly from the body in a direction substantially opposite the root, yet spaced behind the depth gauge, ending in a cutter tip, the element curling out of the plane into one half-space;

(v) at least one reinforcing corrugation in the vicinity of the curl of the element outwardly from the body to reinforce this curl and to further reduce crimping and breakage of the element; and (b) a second link, being substantially a mirror image of the first link, positioned adjacent the first link in substantial alignment with the first link to form a side cutter tooth capable of simultaneously cutting slits on both sides of a kerf when moving as part of the saw chain, said cutter element further including means for substantially eliminating deflection of each link outwardly when the element experiences a downwardly directed force, said means for substantially eliminating deflection including analogously sloped inner and outer faces of the element at a tip of the element so that the resolved horizontal component of the prying force is too small to cause outward deflection and the slope of the outer face is greater than the slope of the inner face.

11. A chain saw side cutter tooth, comprising:

a first link having (i) a body defining a plane for the tooth and two half-spaces separated by the plane;

(ii) a root, extending from the body in the plane, capable of engaging a sprocket of the chain saw;

(iii) a leading depth gauge extending laterally outwardly from the body in a direction substantially opposite the root but in the plane;

(iv) a trailing cutter element extending laterally outwardly from the body in a direction substantially opposite the root, yet spaced behind the depth gauge, ending in a cutter tip, the element curling out of the plane into one half-space, and bending substantially at the intersection of the body and the element when the element is exposed to inwardly directed forces which tend to flatten the element from the half-space into the plane; and (v) at least one reinforcing corrugation in the vicinity of the curling out of the plane to reinforce the curl to further reduce crimping and breakage of the element, wherein the cutter tip comprises about the final 0.030"–0.035" of the element and extends upwardly from about substantially parallel to the plane of the body to about 50° pitched inwardly toward the plane of the body to further protect the tooth against crimping and breakage, the cutter tooth further comprising a second link, being substantially a mirror image of the first link, positiond adjacent the first link in substantial alignment with the first link to form a side cutter tooth capable of simultaneously cutting slits on both sides of a kerf when moving as part of the saw chain.

* * * * *